US007928973B2

(12) United States Patent
Oku et al.

(10) Patent No.: US 7,928,973 B2
(45) Date of Patent: Apr. 19, 2011

(54) POWER SUPPLY CIRCUIT, LCD DRIVER IC AND LIQUID CRYSTAL DISPLAY DEVICE

(75) Inventors: Hironori Oku, Kyoto (JP); Takashi Sato, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 1068 days.

(21) Appl. No.: 11/724,746

(22) Filed: Mar. 16, 2007

(65) Prior Publication Data

US 2007/0216671 A1 Sep. 20, 2007

(30) Foreign Application Priority Data

Mar. 20, 2006 (JP) ..... 2006-077158

(51) Int. Cl.
*G09G 5/00* (2006.01)

(52) U.S. Cl. ..... 345/211

(58) Field of Classification Search ..... 345/87, 345/101–102, 204, 313, 211
See application file for complete search history.

(56) References Cited

U.S. PATENT DOCUMENTS

| | | | | |
|---|---|---|---|---|
| 5,041,821 | A * | 8/1991 | Onitsuka et al. | 345/101 |
| 5,414,441 | A * | 5/1995 | Memarzadeh et al. | 345/87 |
| 5,621,306 | A * | 4/1997 | Ise | 323/313 |
| 5,936,604 | A * | 8/1999 | Endou | 345/101 |
| 6,115,021 | A * | 9/2000 | Nonomura et al. | 345/101 |
| 6,731,265 | B1 * | 5/2004 | Kokuhata et al. | 345/101 |
| 6,919,883 | B2 * | 7/2005 | Lee | 345/204 |
| 7,403,186 | B2 * | 7/2008 | Lee | 345/102 |

FOREIGN PATENT DOCUMENTS

| | | |
|---|---|---|
| JP | 06-314076 | 11/1994 |
| JP | 11-231350 | 8/1999 |

* cited by examiner

*Primary Examiner* — Quan-Zhen Wang
*Assistant Examiner* — Tony Davis
(74) *Attorney, Agent, or Firm* — Fish & Richardson P.C.

(57) ABSTRACT

A power supply circuit is provided with a temperature gradient variable circuit that produces a gradient voltage whose voltage level varies with a temperature gradient commensurate with the ambient temperature and a temperature gradient setting circuit that produces an output voltage (and hence a drive voltage of an LCD panel) by adjusting the temperature gradient and the voltage level of the gradient voltage. With this configuration, it is possible to supply the optimal drive voltage despite variations in the ambient temperature or variations in characteristics of LCD panels.

17 Claims, 4 Drawing Sheets

POWER SUPPLY CIRCUIT, LCD DRIVER IC AND LIQUID CRYSTAL DISPLAY DEVICE

This application is based on Japanese Patent Application No. 2006-077158 filed on Mar. 20, 2006, the contents of which are hereby incorporated by reference.

BACKGROUND OF THE INVENTION

1. Field of the Invention

The present invention relates to power supply circuits that produce a desired output voltage from an input voltage, and to LCD driver ICs/circuits and liquid crystal display devices provided with such power supply circuits.

2. Description of Related Art

In recent years, as information display means of electronic devices, liquid crystal display devices provided with active-matrix liquid crystal display panels (hereinafter "LCD panels") have come to be used increasingly widely for their improved visibility and responsivity.

Some examples of conventionally known active-matrix LCD panels are TFT (thin-film transistor) LCD panels and TFD (thin-film diode) LCD panels that employ thin-film transistors and thin-film diodes, respectively, as active elements for driving liquid crystal cells.

The number of terminals of each active element of the TFD LCD panels is one fewer than that of each active element of the TFT LCD panels. In addition, the TFD LCD panels have a simpler configuration, provide a higher pixel aperture ratio (and hence higher light use efficiency), and operate with less electric power consumption than the TFT LCD panels. For these reasons, as display means of electronic devices (such as cellular phone terminals) that require high brightness and low electric power consumption, the TFD LCD panels have been receiving much attention and have already been put to practical use.

However, the optimal drive voltage of the thin-film diode varies with the ambient temperature with a given gradient due to its element characteristics, and the temperature gradient thereof varies over a wide range (for example, over a range on the order of −40 mV/° C. to −110 mV/° C.) due to, for example, variations in characteristics of the LCD panels. Furthermore, the optimal drive voltage of the thin-film diode has a nonlinear characteristic that the temperature gradient thereof sharply increases when the ambient temperature falls below a predetermined temperature. Thus, to keep a uniform display contrast of the TFD LCD panel, an appropriate voltage needs to be constantly applied to the liquid crystal cells thereof. For this purpose, the actual drive voltage of the thin-film diode of each LCD panel needs to be compensated optimally according to temperature.

As an example of a conventional technology related to the present invention, JP-A-H11-231350 (hereinafter "Patent Document 1") discloses and proposes a liquid crystal display device that drives a liquid crystal cell formed between first and second substrates supporting a liquid crystal by means of a pixel-switching nonlinear resistor element formed on the first substrate. This liquid crystal display device is provided with: a monitoring nonlinear resistor element formed on the first substrate at the same time as the pixel-switching nonlinear resistor element is formed thereon; and temperature compensation means that adds temperature compensation to a condition for driving the liquid crystal cell based on a current-voltage characteristic of the monitoring nonlinear resistor element, the current-voltage characteristic being obtained by energizing the monitoring nonlinear resistor element.

As another example of a conventional technology related to the present invention, JP-A-H06-314076 (hereinafter "Patent Document 2") discloses and proposes a liquid crystal display device provided with a first control circuit that has a temperature detecting element for detecting the temperature of a liquid crystal element and sets a drive voltage of the liquid crystal element according to an output value of the temperature detecting element and a second control circuit that sets a drive voltage of the liquid crystal element in a low temperature region based on the output value of the temperature detecting element and a previously set value, wherein an output voltage can be switched either to the voltage set by the first control circuit or the voltage set by the second control circuit at a certain temperature in the low temperature region.

Certainly, by adopting the conventional technology disclosed in Patent Document 1, it is possible to maintain high display quality even when the current-voltage characteristic of the thin-film diodes varies with temperature. Alternatively, by adopting the conventional technology disclosed in Patent Document 2, it is possible to obtain the optimal display contrast by providing a drive voltage needed by the LCD panel even in the low temperature region.

However, since the conventional technology disclosed in Patent Document 1 is so configured as to detect the ambient temperature on the LCD panel side, an extra signal line is needed between the LCD panel and a control portion (an LCD driver IC) to transmit a monitoring result obtained on the LCD panel side to the control portion side. This makes it difficult to make the liquid crystal display device thinner and lighter, and hampers the cost reduction thereof.

On the other hand, the conventional technology disclosed in Patent Document 2 simply compensates for the nonlinear characteristic of the optimal drive voltage of the LCD panel, and thus gives no consideration to variations in the temperature gradient that become more pronounced when thin-film diodes are used as active elements.

SUMMARY OF THE INVENTION

In view of the conventionally experienced problems described above, an object of the present invention is to provide power supply circuits that can constantly supply the optimal drive voltage despite variations in the ambient temperature or variations in characteristics of LCD panels, and to provide LCD driver ICs/circuits and liquid crystal display devices provided with such power supply circuits.

To achieve the above object, according to the present invention, a power supply circuit is provided with a temperature gradient variable circuit that produces a gradient voltage whose voltage level varies with a temperature gradient commensurate with the ambient temperature and a temperature gradient setting circuit that produces a first drive voltage of a load by adjusting the temperature gradient and/or the voltage level of the gradient voltage.

According to the present invention, unlike Patent Document 2, adjustment is not made by detecting the temperature of a liquid crystal element.

Other features, elements, steps, advantages and characteristics of the present invention will become more apparent from the following detailed description of preferred embodiments thereof with reference to the attached drawings.

DETAILED DESCRIPTION OF PREFERRED EMBODIMENTS

Hereinafter, the present invention will be described by way of an example in which it is applied to a power supply circuit (DC/DC converter) for a liquid crystal display device incorporated in a cellular phone terminal.

Figure 1:
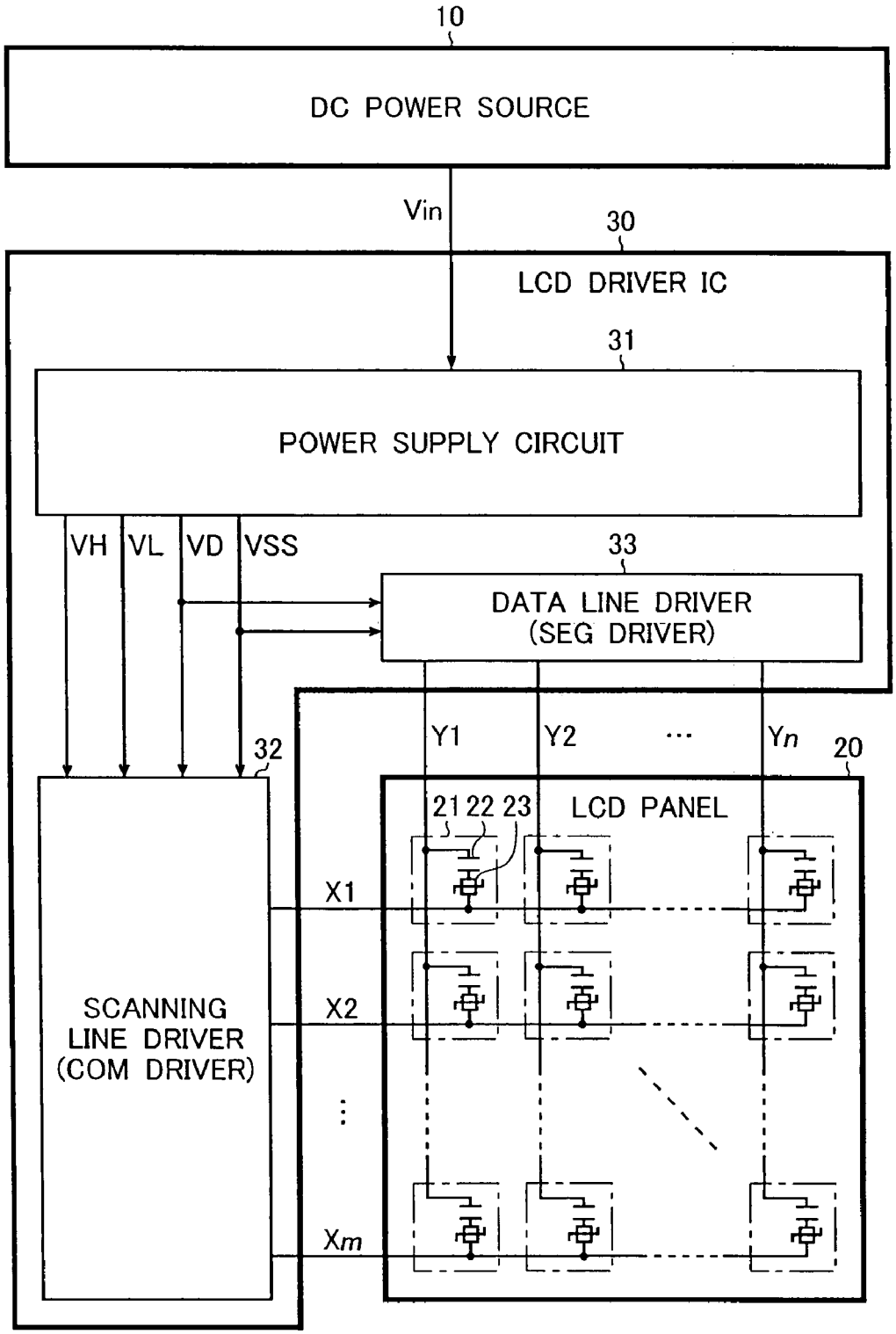
FIG. 1 is a block diagram showing an embodiment of a cellular phone terminal according to the present invention.

FIG. 1 is a block diagram showing an embodiment of a cellular phone terminal according to the invention. As shown in the figure, this cellular phone terminal includes a DC (direct-current) power source 10 that supplies electric power to the terminal, a liquid crystal display panel 20 (hereinafter "LCD panel 20") on which the terminal displays information etc., and an LCD driver IC 30 that drives and controls the LCD panel 20. Needless to say, the cellular phone terminal further includes, although unillustrated, other functional blocks with which it achieves its essential capabilities (communication and other capabilities), such as a transmitter/receiver circuit, a loudspeaker, a microphone, a display, an operation panel, and a memory.

The DC power source 10 supplies electric power to different parts of the terminal; it may be a rechargeable battery such as a lithium-ion battery, or an AC/DC converter that produces a DC voltage from a commercially distributed AC (alternating-current) voltage.

The LCD panel 20 is of the TFD (thin-film diode) active-matrix type; specifically, it has a plurality of scanning lines X1 to Xm (where m is a prescribed natural number) laid in the horizontal direction, and has a plurality of data lines Y1 to Yn (where n is a prescribed natural number) laid in the vertical direction, with a liquid crystal cell 22 forming a pixel 21 located at each intersection between those scanning and data lines, the liquid crystal cell 22 being driven by a corresponding active element (a thin-film diode 23) being turned ON and OFF.

For the sake of simplicity, the embodiment under discussion deals with a configuration where each pixel 21 contains one liquid crystal cell 22 and one thin-film diode 23 (i.e., a configuration for monochrome display). This, however, is not meant to limit the application of the invention in any way; the invention is applicable also to, for example, a configuration for color display with three colors, namely R, G, and B, in which case each pixel may contain three liquid crystal cells and three thin-film diodes corresponding to R, G, and B respectively.

The embodiment under discussion deals with a configuration where, in each pixel 21, the liquid crystal cell 22 and the thin-film diode 23 are serially connected, with the liquid crystal cell 22 connected to the corresponding data line, one of Y1 to Yn, and the thin-film diode 23 connected to the corresponding scanning line, one of X1 to Xm. This, however, is not meant to limit the application of the invention in any way; the invention is applicable also to, for example, a configuration where the liquid crystal cell 22 and the thin-film diode 23 are connected the other way around.

The LCD driver IC 30 includes a power supply circuit 31, a scanning line driver (common driver, or COM driver) 32, and a data line driver (segment driver, or SEG driver) 33.

The power supply circuit 31 operates from an input voltage V1*n* supplied from the DC power source 10. The power supply circuit 31 produces a reference voltage VSS and other internal voltages (VH, VL, and VD) from the input voltage V1*n*, and feeds them to different parts (such as the scanning line driver 32 and the data line driver 33) of the IC.

The internal voltages VH and VL vary with the ambient temperature (e.g., the internal voltage VH varies between +5 V and +22.5 V, and the internal voltage VL varies between −18.5 V and −1 V). By contrast, the internal voltage VD is produced from a band gap voltage, which does not depend on the ambient temperature, and is therefore constant (e.g., +4 V). The reference voltage VSS equals the ground voltage (o V).

According to image signals and timing control signals (of which none is illustrated) fed in from outside the IC, the scanning line driver 32 and the data line driver 33 produce scanning signals and data signals with which to drive the LCD panel 20, and feed those signals via the scanning lines X1 to Xm and the data lines Y1 to Yn to the LCD panel 20.

Figure 2:
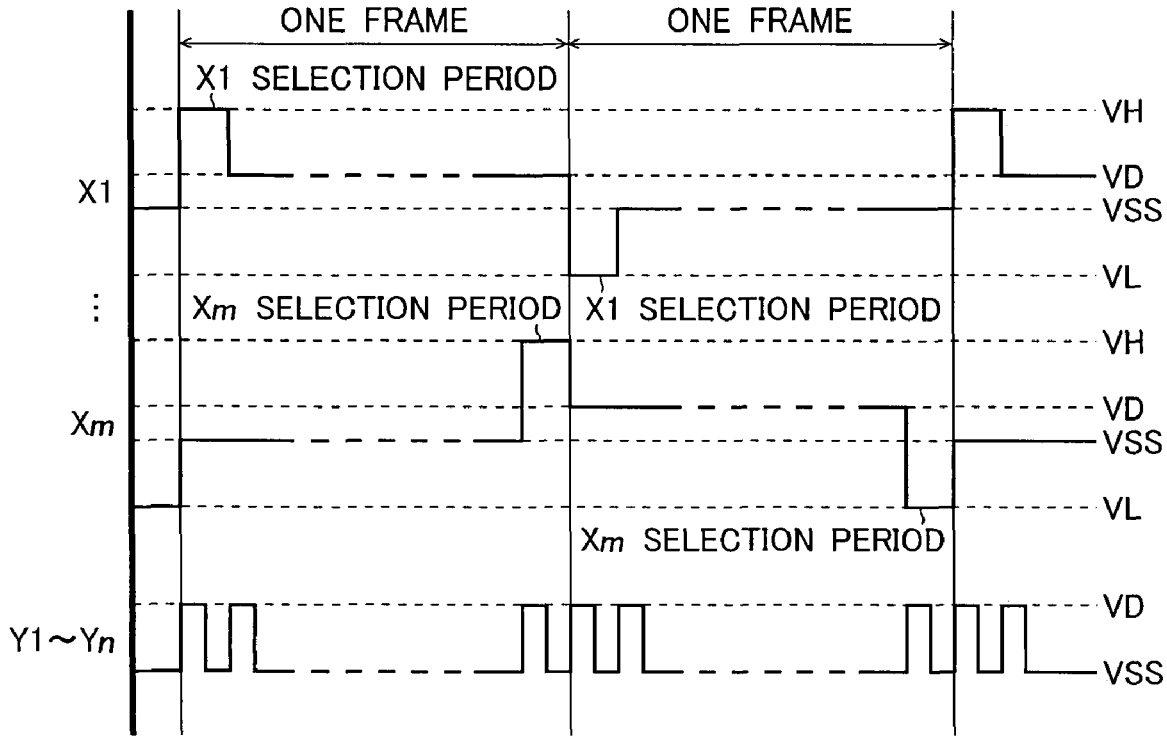
FIG. 2 is a timing chart showing an example of scanning signals and data signals.

Here, the LCD panel 20 is driven in the following manner (by so-called four-level driving). The scanning signals fed via the scanning lines X1 to Xm to the LCD panel 20 are controlled as shown in FIG. 2. Specifically, within each frame period, the scanning lines X1 to Xm are selected one after the next, and one at a time, so that, during the period in which a given scanning line is selected (i.e., during its selection period), either a positive, first selection voltage (the internal voltage VH) or a negative, second non-selection voltage (the internal voltage VD), alternately between consecutive frames, is applied to that scanning line and, during the period in which a given scanning line is not selected (i.e., during its non-selection period), either a first non-selection voltage (the internal voltage VD) or a second non-selection voltage (the reference voltage VSS), alternately between consecutive frames, is applied to that scanning line. This manner of driving helps reduce degradation of image quality compared with one in which the polarity of the selection voltage applied in consecutive frame periods remains constant.

The data signals fed via the data lines Y1 to Yn to the LCD panel 20 are controlled as shown in FIG. 2. Specifically, with either the internal voltage VD or the reference voltage VSS applied to each data line at a time, the data signal on that signal line is a binary signal, and its ON duty within the selection period of a given scanning line is so controlled as to control the gray scale level of the corresponding pixel.

Thus, to produce the scanning signals, the scanning line driver 32 requires, in addition to the reference voltage VSS, the internal voltages (VH, VL, and VD) having three different levels; to produce the data signals, the data line driver 33 requires the reference voltage VSS and the internal voltage VD.

Here, the temperature characteristic (temperature gradient) of the optimal drive voltage of the thin-film diode 23 varies over a wide range (for the positive, first selection voltage VH, over a range on the order of −40 mV/° C. to −110 mV/° C.) due to, for example, variations in characteristics of a given LCD panel 20, and the temperature gradient thereof steepens in a low temperature region. Thus, to keep a uniform display contrast of the LCD panel 20, the internal voltages VH and VL produced in the power supply circuit 31 of the LCD panel 20 need to be adjusted (compensated optimally according to temperature).

Figure 3:
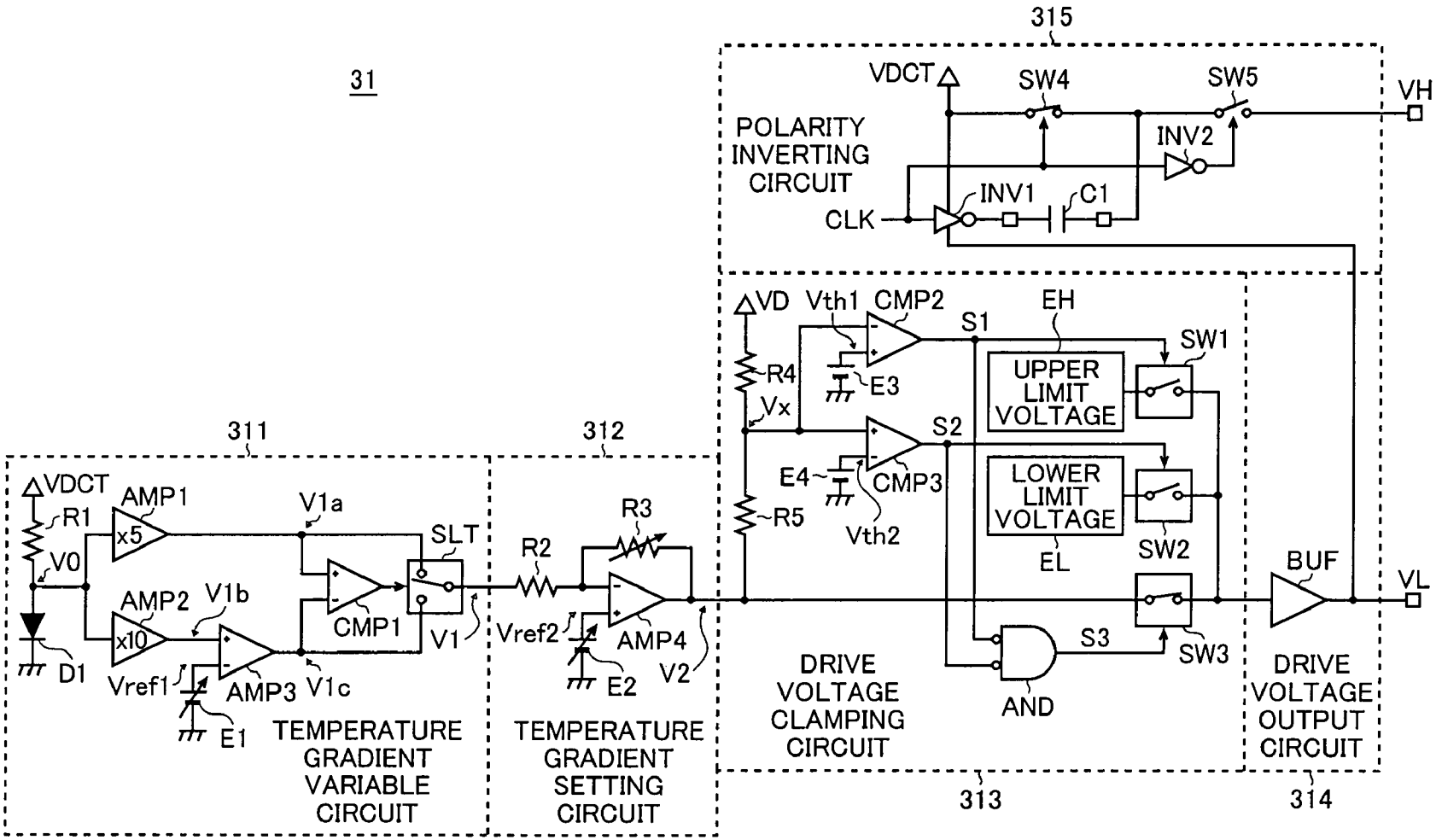
FIG. 3 is a circuit block diagram showing an example of the configuration of a power supply circuit 31.

FIG. 3 is a circuit block diagram showing an example of the configuration of the power supply circuit 31 (in particular, the circuit portions thereof for producing the internal voltages VH and VL).

To produce the internal voltages VH and VL, the power supply circuit 31 of this embodiment includes a temperature gradient variable circuit 311 that produces a gradient voltage V1 whose voltage level varies with a temperature gradient commensurate with the ambient temperature, a temperature gradient setting circuit 312 that produces an output voltage V2 (and hence the internal voltage VL) by adjusting the temperature gradient and/or the voltage level of the gradient voltage V1, a drive voltage clamping circuit 313 that sets upper and lower limits for the voltage level (absolute level) of the internal voltage VL, a drive voltage output circuit 314 that outputs the internal voltage VL to the scanning line driver 32, and a polarity inverting circuit 315 that produces the internal voltage VH by inverting the polarity of the internal voltage VL and then outputs the resultant voltage to the scanning line driver 32.

The temperature gradient variable circuit 311 is composed of a resistor R1, a diode D1, amplifiers AMP1 to AMP3, a DC (direct-current) voltage source E1, a comparator CMP1, and a selector SLT.

One end of the resistor R1 is connected to a terminal to which an internal voltage VDCT (=½ VD; in this embodiment, +2 V) is applied, and the other end thereof is connected to the anode of the diode D1, and to the input terminals of the amplifiers AMP1 and AMP2. The cathode of the diode D1 is connected to a terminal to which the reference voltage VSS is applied. The output terminal of the amplifier AMP1 is connected to the non-inverting input terminal (+) of the comparator CMP1, and to the first selection contact of the selector SLT. The output terminal of the amplifier AMP2 is connected to the non-inverting input terminal (+) of the differential amplifier AMP3. The inverting input terminal (−) of the differential amplifier AMP3 is connected to the positive terminal of the DC voltage source E1. The negative terminal of the DC voltage source E1 is connected to a terminal to which the reference voltage VSS is applied. The output terminal of the differential amplifier AMP3 is connected to the inverting input terminal (−) of the comparator CMP1, and to the second selection contact of the selector SLT. The DC voltage source E1 can adjust a voltage produced thereby (a first reference voltage Vref1) by resistor trimming or the like.

The temperature gradient setting circuit 312 is composed of resistors R2 and R3, an amplifier (operational amplifier) AMP4, and a DC voltage source E2, and is built as an inverting amplifier circuit that outputs the output voltage V2 of the amplifier AMP4 as the internal voltage VL.

The inverting input terminal (−) of the amplifier AMP4 is connected to the common contact of the selector SLT via the resistor R2, and to the output terminal of the amplifier AMP4 via the resistor R3. The non-inverting input terminal (+) of the amplifier AMP4 is connected to the positive terminal of the DC voltage source E2. The negative terminal of the DC voltage source E2 is connected to a terminal to which the reference voltage VSS is applied. The DC voltage source E2 is composed of a switched capacitor and the like, and can adjust the voltage level of a voltage produced thereby (a second reference voltage Vref2) according to a given control signal (not shown). In addition, the resistor R3 can adjust the resistance value thereof according to a given control signal (not shown).

In the temperature gradient setting circuit 312 of this embodiment, to produce a negative output voltage V2 (the internal voltage VL), the amplifier AMP4 is supplied at the negative power supply terminal thereof with a negative voltage from an unillustrated negative step-up charge pump.

The drive voltage clamping circuit 313 is composed of resistors R4 and R5, DC voltage sources E3 and E4, comparators CMP2 and CMP3, an upper limit voltage producing circuit EH, a lower limit voltage producing circuit EL, an AND circuit AND, and switches SW1 to SW3. The drive voltage output circuit 314 is composed of a buffer BUF.

One end of the resistor R4 is connected to a terminal to which the internal voltage VD is applied, and the other end thereof is connected to one end of the resistor R5, and to the inverting input terminal (−) of the comparator CMP2 and the non-inverting input terminal (+) of the comparator CMP3. The other end of the resistor R5 is connected to the output terminal of the amplifier AMP4, and to one end of the switch SW3. The non-inverting input terminal (+) of the comparator CMP2 is connected to the positive terminal of the DC voltage source E3. The inverting input terminal (−) of the comparator CMP3 is connected to the positive terminal of the DC voltage source E4. The negative terminals of the DC voltage sources E3 and E4 are connected to a terminal to which the reference voltage VSS is applied. The output terminal of the comparator CMP2 is connected to one inverting input terminal of the AND circuit AND, and to the open/close control terminal of the switch SW1. The output terminal of the comparator CMP3 is connected to the other inverting input terminal of the AND circuit AND, and to the open/close control terminal of the switch SW2. The output terminal of the upper limit voltage producing circuit EH is connected to one end of the switch SW1. The output terminal of the lower limit voltage producing circuit EL is connected to one end of the switch SW2. The other ends of the switch SW1 to SW3 are connected together at a node, which is connected, via the buffer BUF, to a terminal from which the internal voltage VL is extracted.

The polarity inverting circuit 315 is composed of a capacitor C1, inverters INV1 and INV2, and switches SW4 and SW5.

The input terminals of the inverters INV1 and INV2 are connected to a terminal to which a clock signal CLK is applied. The output terminal of the inverter INV1 is connected to one end of the capacitor C1 that is connected outside the power supply circuit 31. The positive power supply terminal of the inverter INV1 is connected to a terminal to which the internal voltage VDCT is applied, and to one end of the switch SW4, and the negative power supply terminal thereof is connected to the output terminal (i.e., the terminal from which the internal voltage VL is extracted) of the buffer BUF. The other end of the capacitor C1 is connected to the other end of the switch SW4 and to one end of the switch SW5. The other end of the switch SW5 is connected to a terminal from which the internal voltage VH is extracted. The open/close control terminal of the switch SW4 is connected to the terminal to which the clock signal CLK is applied. The open/close control terminal of the switch SW5 is connected to the output terminal of the inverter INV2.

Next, with reference to FIG. 3 described above and FIGS. 4A to 4D, the operation performed in the power supply circuit 31 configured as described above for producing the internal voltages VH and VL will be described in detail.

FIGS. 4A to 4D are diagrams illustrating the operation for producing the internal voltages VH and VL and showing the correlation between the ambient temperature and the voltages and signal logics of the relevant circuit blocks of the power supply circuit 31.

First, the operation of the temperature gradient variable circuit 311 will be described.

The temperature gradient variable circuit 311 of this embodiment is so configured as to, by exploiting the characteristic (the negative temperature characteristic of about −2 mV/° C.) of the diode D1 having Vf (forward voltage drop) that varies almost linearly with the ambient temperature, extract a reference gradient voltage V0 (a voltage signal whose voltage level decreases as the ambient temperature increases) from the anode of the diode D1, and produce a gradient voltage V1 having an appropriate temperature gradient (in this embodiment, a voltage whose temperature gradient doubles when the ambient temperature falls below a threshold temperature T2) from the reference gradient voltage V0.

Figure 4A:
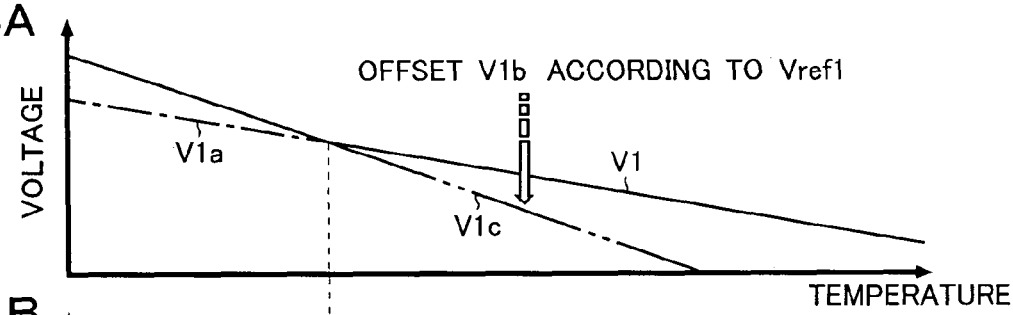
FIGS. 4A to 4D are diagrams illustrating the operation for producing internal voltages VH and VL.

The amplifier AMP1 amplifies the reference gradient voltage V0 by a first gain (in this embodiment, by a factor of 5), thereby producing a first gradient voltage V1*a* (see an alternate long and short dashed line in FIG. 4A). That is, the temperature characteristic of the first gradient voltage V1*a* is −10 mV/° C.

On the other hand, the amplifier AMP2 amplifies the reference gradient voltage V0 by a second gain (in this embodiment, by a factor of 10) that is greater than the first gain, thereby producing a second gradient voltage V1*b*. That is, the temperature characteristic of the second gradient voltage V1*b* is −20 mV/° C.

The differential amplifier AMP3 outputs the difference between the second gradient voltage V1*b* and the first reference voltage Vref1 as a third gradient voltage V1*c* (see a chain double-dashed line in FIG. 4A). That is, the third gradient voltage V1*c* is the second gradient voltage V1*b* offset toward a lower level according to the first reference voltage Vref1. By giving such an offset, the first gradient voltage V1*a* and the third gradient voltage V1*c* are made to intersect at a predetermined temperature.

Considering that the temperature gradient of the optimal drive voltage of the LCD panel 20 changes at the threshold temperature T2, advisably, the voltage level (offset level) of the first reference voltage Vref1 may be appropriately adjusted so that the first gradient voltage V1*a* and the third gradient voltage V1*c* interest at the threshold temperature T2.

The comparator CMP1 changes the output logic thereof according to whether the first gradient voltage V1*a* is higher or lower than the third gradient voltage V1*c*. Specifically, the comparator CMP1 outputs a high level when the first gradient voltage V1*a* is higher than the third gradient voltage V1*c*. Otherwise, the comparator CMP1 outputs a low level.

According to the output logic of the comparator CMP1, the selector SLT selects the first gradient voltage V1*a* or the third gradient voltage V1*c* and outputs the selected voltage as a gradient voltage V1. Specifically, when the comparator CMP1 outputs a high level, the selector SLT selects the first gradient voltage V1*a* and outputs it as a gradient voltage V1; when the comparator CMP1 outputs a low level, the selector SLT selects the third gradient voltage V1*c* and outputs it as a gradient voltage V1. That is, the selector SLT selects one of the first gradient voltage V1*a* and the third gradient voltage V1*c*, depending on which has a higher voltage, and outputs the selected voltage as a gradient voltage V1 (see a solid line in FIG. 4A).

As described above, the temperature gradient variable circuit 311 of this embodiment produces the gradient voltage V1 whose temperature gradient automatically doubles when the ambient temperature falls below the threshold temperature T2. With a configuration in which the internal voltages VL and VH, which will be described below, are produced based on the gradient voltage V1 described above, even when the optimal drive voltage of the LCD panel 20 has a nonlinear characteristic with respect to the ambient temperature, an appropriate voltage can be constantly applied to the liquid crystal cell 22 of the LCD panel 20, and hence a display contrast of the LCD panel 20 can be kept uniform.

Next, the operation of the temperature gradient setting circuit 312 will be described.

The temperature gradient setting circuit 312 produces the output voltage V2 (and hence the internal voltage VL) by inverting and amplifying the gradient voltage V1.

To change the temperature gradient and/or the voltage level of the output voltage V2 (and hence the internal voltages VL and VH) of a given LCD panel 20 in a consecutive or step-by-step (for example, in 32 steps) manner, the temperature gradient setting circuit 312 of this embodiment includes the DC voltage source E2 that has a switched capacitor or the like and can adjust the voltage level of the voltage produced thereby (the second reference voltage Vref2) according to a given control signal (not shown) and the resistor R3 that can adjust the resistance value thereof according to a given control signal (not shown).

With this configuration, by appropriately setting the voltage level of the second reference voltage Vref2, it is possible to make fine adjustments to the voltage levels of the internal voltages VL and VH, and, by appropriately setting the resistance value of the resistor R3, it is possible to vary the temperature gradients of the internal voltages VL and VH. Thus, even when the temperature characteristic (temperature gradient) of the optimal drive voltage of the LCD panel 20 varies greatly due to variations in characteristics thereof, it is possible to constantly apply an appropriate voltage to the liquid crystal cell 22 of the LCD panel 20, and therefore, it is possible to keep a uniform display contrast of the LCD panel 20.

Next, the operation of the drive voltage clamping circuit 313 will be described.

The internal voltage VL produced in the temperature gradient variable circuit 311 and the temperature gradient setting circuit 312, which have been described above, and the internal voltage VH produced in the polarity inverting circuit 315, which will be described below, each vary with the ambient temperature with the temperature characteristic described above. However, if the ambient temperature falls below a predetermined threshold temperature T1 (for example, −25° C.), the voltage levels of the internal voltages VL and VH may become too high and exceed the withstand voltage of the IC, and at worst may result in the breakdown of the IC. On the other hand, if the ambient temperature exceeds a predetermined threshold temperature T3 (for example, +105° C.), the voltage levels of the internal voltages VL and VH may become too low and affect the display operation.

To avoid this, the drive voltage clamping circuit 313 performs clamping for setting the upper and lower limits for the voltage level (absolute level) of the internal voltage VL (and hence the internal voltage VH).

Figure 4B:
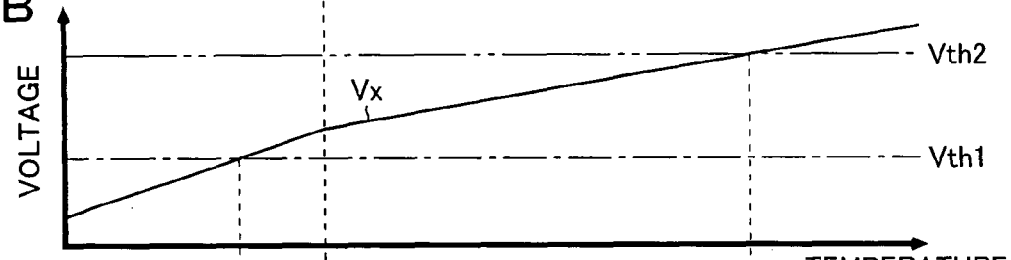
Figure 4C:
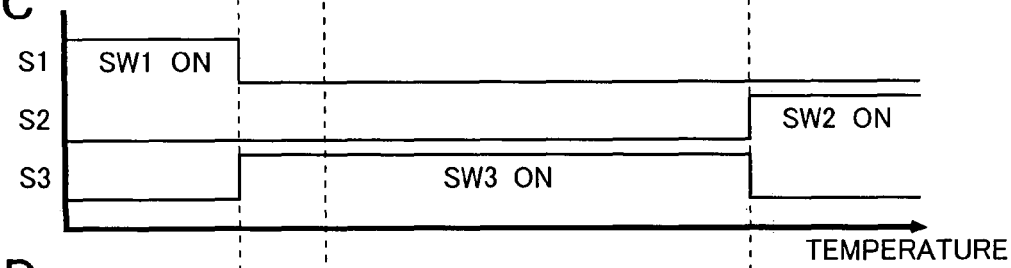

The comparator CMP2 changes the logic of an output signal S1 thereof depending on whether or not a monitor voltage Vx (see a solid line in FIG. 4B) extracted from a connection node between the resistors R4 and R5 is higher than a first threshold voltage Vth1 (see an alternate long and short dashed line in FIG. 4B). Specifically, the output signal S1 takes a low level when the monitor voltage Vx is higher than the first threshold voltage Vth1, and takes a high level when the monitor voltage Vx is lower than the first threshold voltage Vth1 (see the line marked S1 in FIG. 4C).

The voltage level of the first threshold voltage Vth1 may be appropriately set in such a way that the logic of the output signal S1 changes when the ambient temperature has reached the threshold temperature T1.

The comparator CMP3 changes the logic of an output signal S2 thereof depending on whether or not the monitor voltage Vx is higher than a second threshold voltage Vth2 (see a chain double-dashed line in FIG. 4B). Specifically, the output signal S2 takes a high level when the monitor voltage Vx is higher than the second threshold voltage Vth2, and takes a low level when the monitor voltage Vx is lower than the second threshold voltage Vth2 (see the line marked S2 in FIG. 4C).

The voltage level of the second threshold voltage Vth2 may be appropriately set in such a way that the logic of the output signal S2 changes when the ambient temperature has reached the threshold temperature T3.

The AND circuit AND takes the AND of the output signals S1 and S2, which have been inverted and then inputted thereto, thereby producing an output signal S3. That is, the output signal S3 takes a low level when the output signals S1 and S2 are at different levels, and takes a high level when the output signals S1 and S2 are both at a low level (see the line marked S3 in FIG. 4C). It is to be noted that the output signals S1 and S2 are never at a high level at the same time.

On the other hand, the switches SW1 to SW3 are turned ON when they receive the high level output signals S1 to S3, respectively, at their respective open/close control terminals, and are turned OFF when they receive the low level output signals S1 to S3, respectively, at their respective open/close control terminals. Here, as described above, when one of the output signals S1 to S3 takes a high level, the others take a low level. Thus, open/close control of the switches SW1 to SW3 is performed in such a way that the switches are turned ON one at a time, that is, while one of the switches SW1 to SW3 is turned ON, the others are turned OFF.

That is, the drive voltage clamping circuit 313 of this embodiment operates as follows. When the ambient temperature of the power supply circuit 31 is in the range from the threshold temperature T1 inclusive to the threshold temperature T3 exclusive, the output signals S1 and S2 both take a low level and the output signal S3 takes a high level, and therefore the switches SW1 and SW2 are turned OFF and the switch SW3 is turned ON. As a result, the output voltage V2 having the temperature gradient as described above is outputted, as it is, as the internal voltage VL (see the solid line marked VL in the temperature range from the threshold temperature T1 inclusive to the threshold temperature T3 exclusive in FIG. 4D).

When the ambient temperature is below the threshold temperature T1, the output signal S1 takes a high level and the output signals S2 and S3 both take a low level, and therefore the switch SW1 is turned ON and the switches SW2 and SW3 are turned OFF. As a result, an upper limit voltage (in this embodiment, −18.5 V) produced in the upper limit voltage producing circuit EH is outputted from the drive voltage output circuit 314 as the internal voltage VL (see the solid line marked VL below the threshold temperature T1 in FIG. 4D).

When the ambient temperature is equal to or higher than the threshold temperature T3, the output signal S2 takes a high level and the output signals S1 and S3 both take a low level, and therefore the switch SW2 is turned ON and the switches SW1 and SW3 are turned OFF. As a result, a lower limit voltage (in this embodiment, −1 V) produced in the lower limit voltage producing circuit EL is outputted from the drive voltage output circuit 314 as the internal voltage VL (see the solid line marked VL at the threshold temperature T3 and above in FIG. 4D).

With this configuration, it is possible to prevent the voltage level of the internal voltage VL (and VH) having a temperature gradient from becoming too high/low. This makes it possible to prevent the breakdown of the IC and a malfunction in the display operation even when the ambient temperature varies greatly.

Incidentally, to output a negative internal voltage VL, the upper limit voltage producing circuit EH, the lower limit voltage producing circuit EL, and the buffer BUF are supplied at their respective negative power supply terminals a negative voltage from an unillustrated negative step-up charge pump.

Hereinafter, the operation of the polarity inverting circuit 315 will be described.

When the logic of the clock signal CLK is at a high level, the switch SW4 is turned ON and the switch SW5 is turned OFF. At this point, the inverter INV1 outputs a low level (that is, the internal voltage VL). Thus, the capacitor C1 is charged with a voltage corresponding to the difference between the internal voltage VDCT and the internal voltage VL (VDCT minus VL).

On the other hand, when the logic of the clock signal CLK is changed to a low level, the switch SW4 is turned OFF and the switch SW5 is turned ON. At this point, the inverter INV1 outputs a high level (that is, the internal voltage VDCT). Thus, from the terminal from which the internal voltage VH is extracted, a voltage obtained by adding the internal voltage VDCT to the charging voltage of the capacitor C1 (2VDCT-VL) is extracted.

Now, as an example of implementation, assume that the internal voltage VL is −18.5 V. Then, a voltage of +22.5 V is extracted from the terminal from which the internal voltage VH is extracted. Alternatively, assume that the internal voltage VL is −1 V. Then, a voltage of +5 V is extracted from the terminal from which the internal voltage VH is extracted.

Figure 4D:
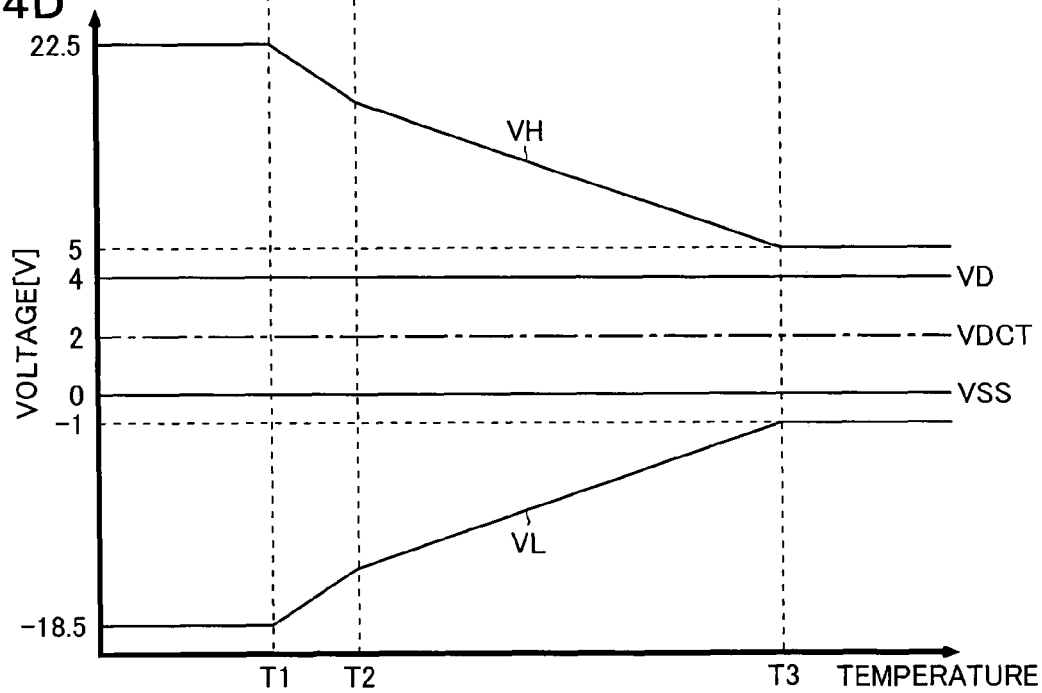

That is, the polarity inverting circuit 315 of this embodiment produces the internal voltage VH by inverting the polarity of the internal voltage VL using the internal voltage VDCT as the reference (see the solid line marked VH in FIG. 4D). With this configuration, production of the internal voltages VH and VL, temperature gradient control, and clamping control can be performed in an integrated manner. This helps prevent an unnecessary increase in circuit size.

Obviously, many modifications and variations of the present invention are possible in light of the above teachings. It is therefore to be understood that within the scope of the appended claims, the invention may the practiced other than as specifically described.

For example, the embodiment described above deals with a configuration in which one diode D1 is used in the temperature gradient variable circuit 311 for producing the reference gradient voltage V0. This, however, is not meant to limit the application of the invention in any way; the invention is applicable also to, for example, a configuration in which an array of two or more diodes or the temperature characteristic of the base-emitter voltage of a bipolar transistor is used for producing the reference gradient voltage V0.

The embodiment described above deals with a configuration in which a negative internal voltage VL is first produced and then the polarity thereof is inverted so as to produce a positive internal voltage VH. This, however, is not meant to limit the application of the invention in any way; the invention is applicable also to, for example, a configuration in which the internal voltages VL and VH are produced the other way around, so that the internal voltage VL is produced from the internal voltage VH.

According to the present invention, it is possible to provide a power supply circuit that can constantly supply the optimal drive voltage despite variations in the ambient temperature or variations in characteristics of LCD panels, and to provide an LCD driver IC/circuit and a liquid crystal display device provided with such a power supply circuit that allows them to keep a uniform display contrast.

The present invention is useful in improving display quality of a liquid crystal display device provided with a TFD LCD panel.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the present invention which fall within the true spirit and scope of the invention.

What is claimed is:

1. A power supply circuit, comprising:

a temperature gradient variable circuit that produces a gradient voltage whose voltage level varies with a temperature gradient commensurate with an ambient temperature; and a temperature gradient setting circuit that produces a first drive voltage of a load by adjusting the temperature gradient and/or the voltage level of the gradient voltage, wherein the temperature gradient variable circuit includes:

a diode having an anode from which a reference gradient voltage is extracted, the anode being connected to an internal voltage application terminal via a first resistor, a first amplifier that produces a first gradient voltage by amplifying the reference gradient voltage by a first gain, a second amplifier that produces a second gradient voltage by amplifying the reference gradient voltage by a second gain that is greater than the first gain, a first DC voltage source that produces a first reference voltage, a third amplifier that outputs a difference between the second gradient voltage and the first reference voltage as a third gradient voltage, and a selector that selects, as the gradient voltage, one of the first gradient voltage and the third gradient voltage, depending on which has a higher voltage.

2. The power supply circuit of claim 1, further comprising:

a drive voltage clamping circuit that setting an upper limit and/or a lower limit for the first drive voltage.

3. The power supply circuit of claim 2, further comprising:

a polarity inverting circuit that produces a second drive voltage of the load by inverting a polarity of the first drive voltage.

4. The power supply circuit of claim 1, wherein the temperature gradient setting circuit includes:

an operational amplifier, a second resistor that is connected, at one end thereof, to an output terminal of the temperature gradient variable circuit and is connected, at the other end thereof, to an inverting input terminal of the operational amplifier, a second DC voltage source that produces a second reference voltage and applies the second reference voltage thus produced to a non-inverting input terminal of the operational amplifier, and a third resistor that is connected, at one end thereof, to the inverting input terminal of the operational amplifier and is connected, at the other end thereof, to an output terminal of the operational amplifier, wherein the temperature gradient setting circuit is an inverting amplifier circuit that outputs an output voltage of the operational amplifier as the first drive voltage of the load, and according to a given control signal, the second DC voltage source can adjust a voltage level of the second reference voltage and/or the third resistor can adjust a resistance value thereof.

5. The power supply circuit of claim 1 wherein the power supply circuit is provided with first, second, and third set temperatures (the first set temperature<the second set temperature<the third set temperature), and a temperature gradient of the output voltage between the first set temperature and the second set temperature is greater than a temperature gradient of the output voltage between the second set temperature and the third set temperature.

6. An LCD driver IC, comprising:

a power supply circuit that produces a drive voltage of a liquid crystal display panel, wherein the power supply circuit includes:

a temperature gradient variable circuit that produces a gradient voltage whose voltage level varies with a temperature gradient commensurate with an ambient temperature, and a temperature gradient setting circuit that produces a first drive voltage of a load by adjusting the temperature gradient and/or the voltage level of the gradient voltage, wherein the temperature gradient variable circuit includes:

a diode having an anode from which a reference gradient voltage is extracted, the anode being connected to an internal voltage application terminal via a first resistor, a first amplifier that produces a first gradient voltage by amplifying the reference gradient voltage by a first gain, a second amplifier that produces a second gradient voltage by amplifying the reference gradient voltage by a second gain that is greater than the first gain, a first DC voltage source that produces a first reference voltage, a third amplifier that outputs a difference between the second gradient voltage and the first reference voltage as a third gradient voltage, and a selector that selects, as the gradient voltage, one of the first gradient voltage and the third gradient voltage, depending on which has a higher voltage.

7. The LCD driver IC of claim 6, wherein an output voltage of the LCD driver IC gradually decreases as an ambient temperature of the LCD driver IC increases.

8. A liquid crystal display device, comprising:

a liquid crystal display panel; and an LCD driver IC that drives and controls the liquid crystal display panel, wherein the LCD driver IC includes a power supply circuit that produces a drive voltage of the liquid crystal display panel, and the power supply circuit includes:

a temperature gradient variable circuit that produces a gradient voltage whose voltage level varies with a temperature gradient commensurate with an ambient temperature, and a temperature gradient setting circuit that produces a first drive voltage of a load by adjusting the temperature gradient and/or the voltage level of the gradient voltage, wherein the temperature gradient variable circuit includes:

a diode having an anode from which a reference gradient voltage is extracted, the anode being connected to an internal voltage application terminal via a first resistor, a first amplifier that produces a first gradient voltage by amplifying the reference gradient voltage by a first gain, a second amplifier that produces a second gradient voltage by amplifying the reference gradient voltage by a second gain that is greater than the first gain, a first DC voltage source that produces a first reference voltage, a third amplifier that outputs a difference between the second gradient voltage and the first reference voltage as a third gradient voltage, and a selector that selects, as the gradient voltage, one of the first gradient voltage and the third gradient voltage, depending on which has a higher voltage.

9. The liquid crystal display device of claim 8, wherein the liquid crystal display panel includes a thin-film diode as an active element that drives a liquid crystal cell.

10. A power supply circuit comprising:

a temperature gradient variable circuit that produces a gradient voltage whose voltage level varies with a temperature gradient commensurate with an ambient temperature; and a temperature gradient setting circuit that produces a first drive voltage of a load by adjusting the temperature gradient and/or the voltage level of the gradient voltage, wherein the temperature gradient setting circuit includes:

an operational amplifier, a second resistor that is connected, at one end thereof, to an output terminal of the temperature gradient variable circuit and is connected, at the other end thereof, to an inverting input terminal of the operational amplifier, a second DC voltage source that produces a second reference voltage and applies the second reference voltage thus produced to a non-inverting input terminal of the operational amplifier, and a third resistor that is connected, at one end thereof, to the inverting input terminal of the operational amplifier and is connected, at the other end thereof, to an output terminal of the operational amplifier, wherein the temperature gradient setting circuit is an inverting amplifier circuit that outputs an output voltage of the operational amplifier as the first drive voltage of the load, and according to a given control signal, the second DC voltage source can adjust a voltage level of the second reference voltage and/or the third resistor can adjust a resistance value thereof.

11. The power supply circuit of claim 10, further comprising:

a drive voltage clamping circuit that setting an upper limit and/or a lower limit for the first drive voltage.

12. The power supply circuit of claim 11, further comprising:

a polarity inverting circuit that produces a second drive voltage of the load by inverting a polarity of the first drive voltage.

13. The power supply circuit of claim 10, wherein the power supply circuit is provided with first, second, and third set temperatures (the first set temperature<the second set temperature<the third set temperature), and a temperature gradient of the output voltage between the first set temperature and the second set temperature is greater than a temperature gradient of the output voltage between the second set temperature and the third set temperature.

14. An LCD driver IC, comprising:

a power supply circuit that produces a drive voltage of a liquid crystal display panel, wherein the power supply circuit includes:

a temperature gradient variable circuit that produces a gradient voltage whose voltage level varies with a temperature gradient commensurate with an ambient temperature, and a temperature gradient setting circuit that produces a first drive voltage of a load by adjusting the temperature gradient and/or the voltage level of the gradient voltage, and wherein the temperature gradient setting circuit includes:

an operational amplifier, a second resistor that is connected, at one end thereof, to an output terminal of the temperature gradient variable circuit and is connected, at the other end thereof, to an inverting input terminal of the operational amplifier, a second DC voltage source that produces a second reference voltage and applies the second reference voltage thus produced to a non-inverting input terminal of the operational amplifier, and a third resistor that is connected, at one end thereof, to the inverting input terminal of the operational amplifier and is connected, at the other end thereof, to an output terminal of the operational amplifier, wherein the temperature gradient setting circuit is an inverting amplifier circuit that outputs an output voltage of the operational amplifier as the first drive voltage of the load, and according to a given control signal, the second DC voltage source can adjust a voltage level of the second reference voltage and/or the third resistor can adjust a resistance value thereof.

15. The LCD driver IC of claim 14, wherein an output voltage of the LCD driver IC gradually decreases as an ambient temperature of the LCD driver IC increases.

16. A liquid crystal display device, comprising:

a liquid crystal display panel; and an LCD driver IC that drives and controls the liquid crystal display panel, wherein the LCD driver IC includes:

a power supply circuit that produces a drive voltage of the liquid crystal display panel, wherein the power supply circuit includes a temperature gradient variable circuit that produces a gradient voltage whose voltage level varies with a temperature gradient commensurate with an ambient temperature, and a temperature gradient setting circuit that produces a first drive voltage of a load by adjusting the temperature gradient and/or the voltage level of the gradient voltage, the temperature gradient setting circuit includes an operational amplifier, a second resistor that is connected, at one end thereof, to an output terminal of the temperature gradient variable circuit and is connected, at the other end thereof, to an inverting input terminal of the operational amplifier, a second DC voltage source that produces a second reference voltage and applies the second reference voltage thus produced to a non-inverting input terminal of the operational amplifier, and a third resistor that is connected, at one end thereof, to the inverting input terminal of the operational amplifier and is connected, at the other end thereof, to an output terminal of the operational amplifier, the temperature gradient setting circuit is an inverting amplifier circuit that outputs an output voltage of the operational amplifier as the first drive voltage of the load, and according to a given control signal, the second DC voltage source can adjust a voltage level of the second reference voltage and/or the third resistor can adjust a resistance value thereof.

17. The liquid crystal display device of claim 16, wherein the liquid crystal display panel includes a thin-film diode as an active element that drives a liquid crystal cell.

* * * * *